US010807053B2

(12) United States Patent
Jakob et al.

(10) Patent No.: US 10,807,053 B2
(45) Date of Patent: Oct. 20, 2020

(54) APPARATUS FOR MIXING A POWDERED MATERIAL WITH A LIQUID

(71) Applicant: Zeppelin Systems GmbH, Friedrichshafen (DE)

(72) Inventors: Ulrich Jakob, Pfungstadt (DE); Andreas Hofmann, Frankfurt am Main (DE)

(73) Assignee: ZEPPELIN SYSTEMS GMBH, Friedrichshafen (DE)

( * ) Notice: Subject to any disclaimer, the term of this patent is extended or adjusted under 35 U.S.C. 154(b) by 48 days.

(21) Appl. No.: 15/715,971

(22) Filed: Sep. 26, 2017

(65) Prior Publication Data

US 2018/0093235 A1 Apr. 5, 2018

(30) Foreign Application Priority Data

Sep. 30, 2016 (DE) ..... 10 2016 118 575

(51) Int. Cl.
*B01F 7/00* (2006.01)
*B01F 5/22* (2006.01)
(Continued)

(52) U.S. Cl.
CPC ..... *B01F 7/00708* (2013.01); *B01F 3/1221* (2013.01); *B01F 3/1271* (2013.01);
(Continued)

(58) Field of Classification Search
CPC ..... B01F 3/1221; B01F 3/1271; B01F 5/225; B01F 7/00208; B01F 7/00258;
(Continued)

(56) References Cited

U.S. PATENT DOCUMENTS 1,587,115 A * 6/1926 Govers ..... B01F 7/183 165/109.1
3,314,395 A * 4/1967 Hemmer ..... C23C 14/042 118/721

(Continued)

FOREIGN PATENT DOCUMENTS

CH 581 496 11/1976
CN 201415112 3/2010

(Continued)

OTHER PUBLICATIONS

EPO English translation of EP-2263467 , 9 pages, retrieved on Sep. 18, 2019. (Year: 2019).*
China Search Report/Office Action conducted in counterpart China Appln. No. 201710897186.9 (dated Jul. 19, 2019) (w/ translation).

*Primary Examiner* — Tony G Soohoo
(74) *Attorney, Agent, or Firm* — Greenblum & Bernstein, P.L.C.

(57) ABSTRACT

Apparatus for mixing a powdered material with a liquid that includes a housing in which a working space having an inner wall is arranged and a rotatably-driven rotor being arranged in the working space. The rotatably-driven rotor includes a blade ring and bars, which are pointing toward the inner wall and are arranged at different positions in a circumferential direction of the rotor. The apparatus also includes a feed opening for the powdered material being arranged above the blade ring and an annular gap connectable to a liquid supply arrangement being arranged below the blade ring. In a direction parallel to an axial direction of the rotor, the bars one of connect to one another or overlap one another.

20 Claims, 3 Drawing Sheets

(51) Int. Cl.
*B01F 7/18* (2006.01)
*B01F 3/12* (2006.01)

(52) U.S. Cl.
CPC ..... *B01F 5/225* (2013.01); *B01F 7/007* (2013.01); *B01F 7/00208* (2013.01); *B01F 7/00258* (2013.01); *B01F 7/00641* (2013.01); *B01F 7/18* (2013.01); *B01F 7/00833* (2013.01)

(58) Field of Classification Search
CPC .. B01F 7/00641; B01F 7/007; B01F 7/00708; B01F 7/00833; B01F 7/18; A21C 1/02; A21C 1/141; A21C 1/1495
See application file for complete search history.

(56) References Cited

U.S. PATENT DOCUMENTS

| | | | |
|---|---|---|---|
| 3,807,702 | A | 4/1974 | Grillo et al. |
| 4,205,920 | A | 6/1980 | Vigano |
| 7,222,725 | B1 | 5/2007 | Somarakis et al. |

FOREIGN PATENT DOCUMENTS

| | | | | |
|---|---|---|---|---|
| DE | 2 29 612 | | 11/1985 | |
| DE | 195 04 772 | | 8/1996 | |
| DE | 10 2009 029 935 | | 12/2010 | |
| DE | 102009029935 | A1 * | 12/2010 | ..... A21D 6/00 |
| EP | 2263467 | A2 * | 12/2010 | ..... A21D 6/00 |
| EP | 2754351 | | 7/2014 | |
| WO | 84/04054 | | 10/1984 | |
| WO | 2007/146528 | | 12/2007 | |

* cited by examiner

APPARATUS FOR MIXING A POWDERED MATERIAL WITH A LIQUID

CROSS-REFERENCE TO RELATED APPLICATIONS

The present application claims priority under 35 U.S.C. § 119 of German Patent Application No. 10 2016 118 57.2, filed Sep. 30, 2016, the disclosure of which is expressly incorporated by reference herein in its entirety.

BACKGROUND OF THE EMBODIMENTS

1. Field of the Invention

The invention relates to an apparatus for mixing a powdered material with a liquid. The apparatus comprises a housing in which a working space having an inner wall is arranged, in the working space, a rotatably-driven rotor is arranged which comprises a blade ring and bars which point in the direction of the inner wall and are arranged at different positions in a circumferential direction of the rotor. A feed opening for the powdered material is arranged above the blade ring and an annular gap connectable to a liquid supply arrangement is arranged below the blade ring.

2. Discussion of Background Information

An apparatus of this type is known, e.g., from DE 2009 029 935 B4, which is an apparatus used to moisten flour. The flour introduced through the feed opening is first distributed by a beater plate arrangement and then supplied to the blade ring. The blade ring comprises blades with folded surfaces so that a narrowing is formed between adjacent blades, as a result of which the air/flour mixture can expand after passing through the narrowing and is thus finely intermixed and becomes extremely homogeneous. This air/flour mixture is then moistened and conducted through an array of shearing bars that once again break up any flour conglomerates which may occur. As a final result, a moistened flour that no longer produces any fine dust is obtained.

SUMMARY

Embodiments of the invention expand the application purpose for an apparatus of this type.

According to embodiments, the apparatus of the type named at the outset includes bars connected to one another or overlapping one another parallel to the axial direction of the rotor.

The rotor rotates at a relatively high rotational speed of several hundred revolutions per minute. In preferred embodiments, the rotor rotates at 1000 to 1500 revolutions per minute. In connection with the fact that the bars connect to one another or overlap one another in an axial direction of the rotor, this results in that in the direction of movement of the powdered material, there is virtually no region in an axial direction in which the powdered material is not impinged upon by the bars. The powdered material is thus impinged upon by the bars to a very large extent, so that virtually no agglomerates of the powdered material can form. This applies also and in particular when this powdered material is then intermixed with the liquid exiting the annular gap under centrifugal force. Thus, a mixture of the liquid and the powdered material that can also produce a dough-like mass results. However, due to the gapless arrangement of the bars in an axial direction, there are also no agglomerates produced in this dough-like mass.

Preferably, bars adjacent in an axial direction comprise in a circumferential direction respectively an angular distance between one another, wherein a first angular distance differs from an adjacent, second angular distance. The bars are "chaotically" distributed in a circumferential direction, that is, if the bars are provided with a first numbering in a circumferential direction and with a second numbering in an axial direction, the two numberings do not coincide. It can thus be avoided that one bar moves in the "wake" of another bar, so that the powdered material also does not collect in the wake of a bar and is not able to form agglomerates.

Here, it is preferred that a first angular distance is positive and a second angular distance is negative. Thus, the bars have an arrangement relative to one another in a circumferential direction in which a relatively large angular distance can occur between bars adjacent in an axial direction. Nevertheless, this need not be the case for all bars. It is, however, adequate if a corresponding angular distance distribution is present for a majority of the bars.

Preferably, the bars are arranged solely on the side of the blade ring facing away from the feed opening. The apparatus is preferably arranged in an alignment extending in the direction of gravity, that is, the rotational axis of the rotor extends in the direction of gravity and the inner wall of the working space also extends in the direction of gravity. Smaller deviations from the direction of gravity are possible. When the powdered material is supplied through the feed opening, then it is not disturbed by bars, but rather reaches the blade ring, where it is spun outwards by the centrifugal force. Under the effect of gravity, it then slides down along the inner wall of the working space and subsequently comes into contact with the supplied liquid. In this region, the bars then begin to act and can mix the powdered material with the liquid.

Preferably, the bars are arranged on both sides of the annular gap in an axial direction. This accounts for the fact that a liquid that exits the annular gap can also be spun upwards against the direction of gravity when the liquid impacts a bar, for example. The wetting of the material located on the inner wall thus also takes place above the annular gap in the direction of gravity, as a consequence of which bars are also provided here to effect the intermixing. The number of sets on both sides of the annular gap can be selected at will.

Preferably, a small distance is embodied between the radial outer end of the bars and the inner wall. This distance depends on the powdered material to be intermixed and on the liquid. It is selected such that a dough that is formed by the mixing of liquid and powdered material is exchanged. In the case of a small distance, the dough is sheared and worked and thus detaches from the inner wall of the housing. As a result of the small distance, a shearing force is produced when the bars move past the inner wall. This shearing force travels over the distance all the way to the inner wall of the working space so that the entire dough is kneaded. A preferably used distance is in the range of 1 to 5 mm, particularly preferably from 1 to 2 mm.

Preferably, the blade ring comprises blades that have, at least at their radial outside, an angle to the circumferential direction in the range of 0° to 8°. The angle is thus relatively small. The blade ring thus also produces only a relatively weak airflow from the feed opening in the direction of the bars. However, this type of slight airflow is easily sufficient to convey the powdered material, since this powdered material is mainly conveyed by the force of gravity anyway. As mentioned above, when it impacts the rotating blades, the powdered material is spun radially outwards onto the inner wall of the working space by the centrifugal force.

Preferably, the blades comprise a twist about an axis extending from the radial inside to the radial outside. The blades thus do not have a uniform inclination to the circumferential direction across their entire radial extension instead, they are preferably twisted. This facilitates production.

Preferably, the housing comprises an outlet at the bottom end of the working space, wherein a bottom edge, which is adjacent to the outlet, of a bar adjacent to the outlet is flush with the bottom edge of the working space, and an outlet section connects to the outlet. Thus, the bar adjacent to the outlet in any case scrapes off the dough forming on the inner wall, or the mixture, so that a dough ring or mixture ring that could impede or even prevent the further removal of the dough forming above the outlet, or of the mixture, cannot form at this position. By way of the outlet section, the dough or the material intermixed with liquid can be brought to a different position, for example, onto a conveyor belt or the like with which it can be transported to a point of use.

Preferably, the outlet section comprises a radial recess in an outward direction across from the outlet opening. The dough scraped off by the bar adjacent to the outlet can thus also accumulate below the outlet opening. If the dough sticks to a wall, it will stick below the outlet opening to a wall which comprises a surface component pointing in the direction of gravity, that is, which is perpendicular to the direction of gravity. From a wall section of this type, the dough can then fall downwards under the effect of the direction of gravity. The same thing also applies here and below if no dough is formed and the powdered material is merely mixed with the liquid.

Preferably, the radial recess corresponds at least to the thickness of a wall of the housing, which wall surrounds the working space. The outlet section can thus be formed in a relatively simple manner by a tube or an annular channel that connects to the housing on the outside. A recess of this type is normally sufficient to elicit a falling-down of the dough.

Preferably, the outlet section is formed from an elastic material that is deformable. If the dough is scraped off by the bar adjacent to the outlet and an accumulation of the dough or of the intermixed powdered material should nevertheless occur on the inner wall of the outlet channel due to any effects, then an accumulation of this type causes the outlet section to expand radially so that a wall section is in turn produced at this position, which wall section is perpendicular to the direction of gravity or at least has a component perpendicular to the direction of gravity. The dough or the intermixed powdered material then falls suitably downwards from a wall section of this type.

Alternatively or additionally, it can be provided that the outlet section widens away from the outlet opening. A widening of this type can be embodied to be funnel-shaped, for example. In this case, it can then also be observed that a dough or a material intermixed with liquid can accumulate. Upon reaching a certain size, however, an accumulation of this type then falls downwards.

Additionally or alternatively, it can be provided that the outlet section comprises a non-stick surface. This non-stick surface can be produced with the material from which the outlet section is formed. Additionally or alternatively, a non-stick coating can also be used so that the dough or the powdered material mixed with liquid cannot stick to the outlet section or can only do so with small adhesive forces.

Preferably, the housing and/or the rotor comprises a heating device. This is particularly advantageous where not water, but rather oil or another fat, for example, is used as a liquid. In this case, the viscosity of the liquid can be reduced by means of a heating.

Embodiments are directed to an apparatus for mixing a powdered material with a liquid. The apparatus includes a housing in which a working space having an inner wall is arranged and a rotatably-driven rotor being arranged in the working space. The rotatably-driven rotor includes a blade ring and bars, which are pointing toward the inner wall and are arranged at different positions in a circumferential direction of the rotor. The apparatus also includes a feed opening for the powdered material being arranged above the blade ring and an annular gap connectable to a liquid supply arrangement being arranged below, the blade ring. In a direction parallel to an axial direction of the rotor, the bars one of connect to one another or overlap one another.

In embodiments, bars adjacent in an axial direction can be separated by angular distances in the circumferential direction. The angular distances can include a first angular distance that differs from an adjacent, second angular distance. Further, the first angular distance may be positive and the second angular distance may be negative.

According to embodiments, the bars can be arranged solely on a side of the blade ring facing away from the feed opening. Moreover, with respect to the axial direction, the bars can be arranged on both sides of the annular gap.

In accordance with other embodiments, small distances can be embodied between radial outer ends of the bars and the inner wall.

In other embodiments, the blade ring can include radially extending blades oriented, at least at their radial outsides, at an angle to the circumferential direction in a range of 2° to 8°. The blades may include a twist about a blade axis extending from a radial inside to a radial outside.

According to further embodiments, the housing can also include an outlet at a bottom end of the working space, in which a bottom edge of a bar adjacent to the outlet is flush with the bottom edge of the working space, and an outlet section connected to the outlet. The outlet section may include a radial recess in an outward direction across from the outlet. The radial recess can correspond at least to a thickness of a wall of the housing surrounding the working space. Further, the outlet section can be formed from an elastic material, the outlet section can widen away from the outlet, and the outlet section includes a non-stick surface.

In accordance with still other embodiments of the invention, at least one of the housing and the rotor may include a heating device.

Embodiments are directed to a method for mixing a powdered material with a liquid. The method includes supplying the powdered material into a working space having an inner wall, distributing the powdered material onto the inner wall via a blade ring arranged within the working space, wetting the powdered material below the blade ring with the liquid and intermixing, the powdered material with the liquid via bars radially extending toward the inner wall from a rotor arranged within the working space. The radially extending bars are axially spaced along the rotor and circumferentially spaced around the rotor.

According to embodiments, the method can further include scraping the intermixed powered material and liquid off the inner wall with a bottommost bar arranged adjacent an outlet formed in a bottom of the working space. Further, the method may include guiding the scraped intermixed powered material and liquid to the outlet.

In other embodiments, the wetting can include distributing the liquid to the powdered material via impingement with the bars.

In accordance with still yet other embodiments of the present invention, the bars do not contact the inner wall.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

Figure 1:
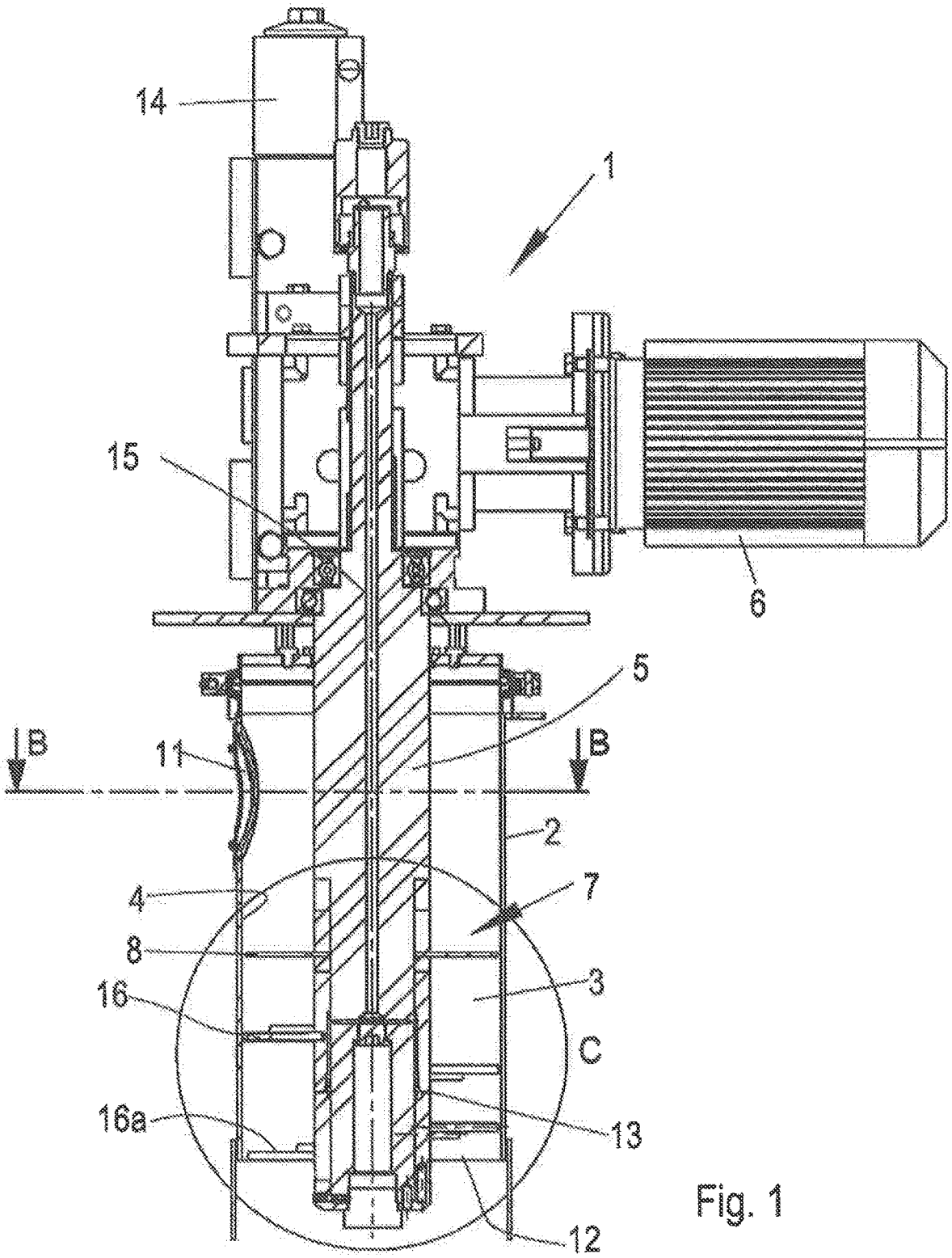
FIG. 1 shows a vertical longitudinal section through an apparatus for mixing a powdered material with a liquid.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

An apparatus 1 for mixing a powdered material with a liquid comprises a housing 2 in which a working space 3 is arranged. The working space 3 comprises an inner wall 4. The inner wall 4 is at the same time the inside wall of the housing 2.

The working space 3 is embodied as a hollow cylinder with a circular cross section. In the working space 3, a rotatably-driven rotor 5 is arranged. The rotor 5 is driven by a motor 6 that is arranged above the housing 2.

Figure 3:
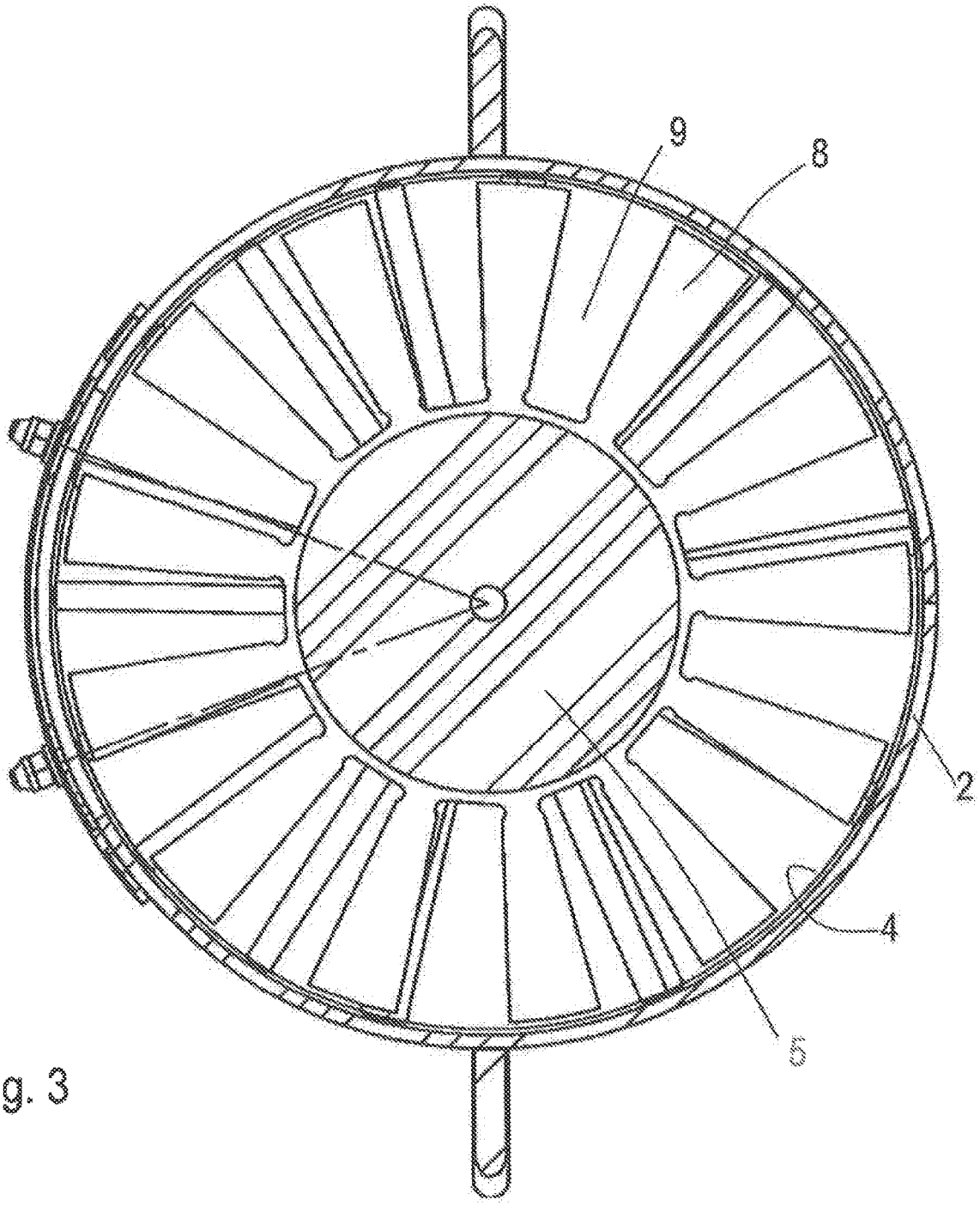
FIG. 3 shows a section BB according to FIG. 1.

The rotor 5 comprises a blade ring 7. The blade ring 7 comprises a plurality of blades 8 distributed in a circumferential direction (FIG. 3). The blades 8 have, at least at their radial outside, an angle to the circumferential direction in the range of 2° to 8°. This inclination is achieved in that the blades 8 comprise a twist about an axis extending from the radial inside to the radial outside. On the radial inside, the blades 8 can be aligned parallel to the circumferential direction. Since the inclination angle is very small, it cannot be seen in the drawing. Gaps 9 are provided between the blades 8.

If the blades 8 are inclined relative to the circumferential direction at their radial outside, this inclination is selected such that, during a rotation of the rotor 5 about the rotor axis 10 thereof, a small airflow results in the direction from a feed opening 11, into which the powdered material can be introduced, to an outlet 12, at which the powdered material mixed with the liquid exits the housing 2. The rotational axis is aligned vertically, that is, parallel to the direction of gravity. Certain deviations from the direction of gravity are possible, as long as the gravitational force is sufficient to convey the powdered material, and subsequently the powdered material mixed with the liquid, from the feed opening 11 to the outlet 12.

On the side of the blade ring 7 facing away from the feed opening 11, the rotor 5 comprises an annular gap 13 which is connected to a liquid supply device 14 via a channel 15.

Figure 2:
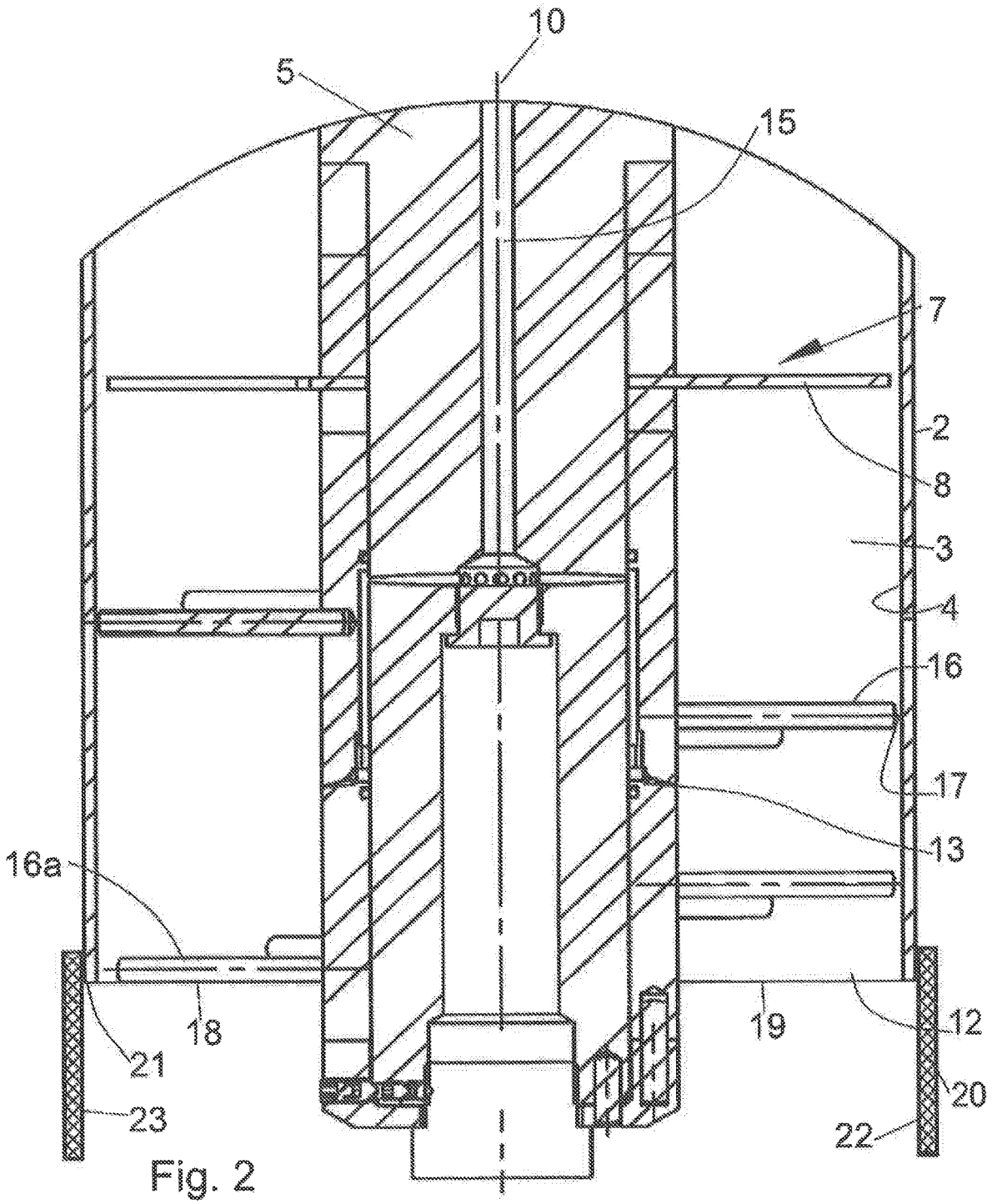
FIG. 2 shows an enlarged detailed view C from FIG. 1.

Furthermore, on the side of the blade ring 7 facing away from the feed opening 11, the rotor 5 comprises bars 16 that are arranged at different positions in a circumferential direction of the rotor 5. As can be seen in FIGS. 1 and 2, the bars 16 slightly overlap in an axial direction of the rotor 5. However, it would also be sufficient if the bars 16 were to connect to one another in an axial direction of the rotor. The effect of this arrangement is that, in the region of the bars 16, the inner wall 4 is scraped over once by a bar 16 at every axial position during a revolution of the rotor 5. As explained further below, a residual ring of the powdered material supplied through the feed opening 11 thus cannot be produced. At all positions, the powdered material, which is spun radially outwards against the inner wall 4 on impact with the blades 8 of the blade ring 7, is scraped off of the inner wall 4, or at least impinged upon, by the bars 16.

The bars 16 are arranged on both sides of the annular gap 13 in an axial direction. The number of bars 16 on each side of the annular gap 13 can essentially be selected at will. If liquid exits the annular gap 13 and is conveyed radially outwards by the centrifugal force, then this liquid also impacts bars 16. On impact with these bars 16, a change in direction then takes place which allows the liquid to reach a region on the inner wall 4 of the working space 3 above the annular gap 13, even against the direction of gravity.

A small distance 17 is embodied between the inner wall 4 and the radial outer end of each bar 16. This distance is normally on the order of magnitude of 1 to 2 mm. However, it depends on the powdered material and the liquid that is to be mixed with the powdered material. During this mixing, a type of dough can be produced for example which sticks to the inner wall 4, wherein a thickness of the dough that is greater than the distance 17 is formed. The distance 17 is then set such that the dough is exchanged. In the case of a small distance 17, the dough is sheared and worked and thus detaches from the inner wall 4 of the working space 3. Because of the small distance 17, a shearing force is produced which travels over the distance 17 all the way to the inner wall 4 of the working space 3 so that the entire dough is kneaded.

In some cases, the intention is not for dough to be produced, but rather merely for the powdered material to be moistened. In such situations, it may be beneficial to select a different distance.

The bars 16 are, when the sequence thereof is viewed parallel to the direction of the axis 10, arranged "chaotically" or irregularly offset from one another in a circumferential direction. Thus, it is avoided that one bar is moved in the "wake" of another bar and a drip edge on one bar impedes the formation of the mixture of the powdered material and liquid on the following bar. The powdered material and the liquid will mainly accumulate at the radial outside. However, even at this position a drip edge can then form at the end of the bar trailing in the circumferential direction or rotation direction, which drip edge can subsequently impede the next highest or next lowest bar in an axial direction, that is, a bar that is more distant from or more proximate to the outlet 12. This chaotic arrangement can be defined, for example, as adjacent bars 16 respectively comprising an angular distance between one another in a circumferential direction, wherein a first angular distance differs from an adjacent, second angular distance. The first angular distance can for example be positive and the second angular distance can for example be negative. The absolute value of the two angular distances thereby does not need to be equal.

As can be seen in FIGS. 1 and 2, the bars 16 are arranged solely on the side of the blade ring 7 facing away from the feed opening 11.

As mentioned above, the outlet 12 is arranged at the bottom end of the housing 2.

A bar 16*a* adjacent to the outlet 12 comprises a bottom edge 18 that is flush with the outlet 12, more precisely, with a bottom edge 19 of the housing 2. The "bottommost bar" 16*a* thus works the powdered material sticking to the inner wall 4, which material is already mixed with the liquid, all the way to the bottom end 19 of the housing 2. At the outlet 12, it is also not possible for a ring of the dough or of the mixture of powdered material and liquid to form.

An outlet section 20 connects to the outlet 12. The outlet section 20 comprises a radial recess 21 in an outward direction across from the outlet 12. This recess 21 corresponds at least to the thickness of a wall of the housing 2, which wall surrounds the working space 3. The mixture of powdered material and liquid conveyed away from the inner wall 4 by the bottommost bar 16*a* will deviate radially outwards onto this recess 21 when the mixture moves downwards in the direction of gravity. The recess 21 constitutes a surface that is aligned perpendicularly to the direction of gravity. At this position, the adhesive strength for the mixture is smaller, as a consequence of which the mixture fails or slides downwards in the direction of gravity more or less on its own.

The outlet section 20 can be formed from an elastic material, for example, by a tube 22 of an elastic plastic. If a larger amount of the mixture accumulates below the outlet 12 in the outlet section 20, then this causes the outlet section 20 to bulge outwards, so that the inside 23 of the outlet section 20 in turn obtains a surface component that is perpendicular to the direction of gravity, as a result of which the mixture can easily detach from the inside 23.

Alternatively or additionally, it can also be provided that the outlet section 20 widens away from the outlet 12 in a radial direction. In this manner, an adhesion of the mixture to the inner wall 23 of the outlet section is also only possible up to a certain limit. Once the mixture exceeds a critical mass, the weight of the mixture is so large that it slides or falls downwards in the direction of gravity.

Additionally and alternatively, it can also be provided that the outlet section 20, at least on its inside 23, comprises a non-stick surface. The non-stick surface can be formed from the material of the outlet section 20 itself. However, the non-stick surface can also be formed by a coating.

The rotor 5 rotates at several hundred revolutions per minute, preferably at 1000 to 1500 revolutions per minute, so that a dwell time of 20 to 30 seconds results for the powdered material that is mixed with liquid in the course of the process.

The apparatus 1 functions as follows:

Powdered material that is supplied through the feed opening 11 falls, under the effect of gravity, onto the blade ring 7, more precisely, onto the blades 8 rotating at this position. Part of the powdered material can pass through the gaps 9 between the blades 8. However, due to the relatively high rotational speed of the rotor 5, a majority of the powdered material will impact the blades. On impact with the blades 8, centrifugal force is applied to the powdered material and the material is conveyed radially outwards until it comes into contact with the inner wall 4 of the working space 3. Under the effect of gravity, a layer of the powdered material then slides downwards along the inner wall 4.

This layer of the powdered material is then wetted by the liquid exiting the annular gap 13. During this wetting, this layer is impinged upon by the bars 16. The layer is thicker than the distance 17 of the layer. The bars 16 then perform a type of kneading operation, which leads to a thorough intermixing of the liquid and the powdered material. Because the bars 16 overlap one another in an axial direction or at least connect to one another in an axial direction, it is not possible for a layer ring that would hinder the layer's further descent to remain on the inner wall 4 of the working space 3. Overall, the "dough" or the mixture of the powdered material and the liquid thus subsequently moves downwards to the outlet 12 due to the effect of gravity.

At the outlet 12, the layer is also impinged upon by the bottommost bar 16*a* and scraped off of the inner wall 4. With the specific embodiment of the outlet section 20, as described above, it is also not possible for any clogging to result at this position.

The apparatus 1 can be used, fear example, to mix flour and water in order to produce a dough.

However, other powdered materials can also be mixed with other liquids. Thus, it is for example possible to make a cocoa powder dust-free by mixing the cocoa powder with a fat, for example, oil. By mixing cocoa powder with the fat, relatively large agglomerates are produced, or said agglomerates can be produced. These agglomerates are then broken down again into smaller and fine agglomerates by the rotating bars 16. The size of the agglomerates can be defined with the bars 16 and the arrangement thereof.

Another possible application would be the production of effervescent powder. In this case, powdered sugar is mixed with water and flavorings. Here, agglomerates are then also produced which can be subsequently dried on a dryer section, where the water is evaporated. The effervescent powder is thus stabilized.

If fat is used as liquid, essentially only a heated rotor and/or a heated housing are necessary. The heating device required therefor, or the heating devices required therefor, are not illustrated in the drawing for the sake of clarity.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for mixing a powdered material with a liquid, comprising:

a housing in which a working space having an inner wall is arranged;

a rotatably-driven rotor being arranged in the working space, the rotatably-driven rotor comprising a blade ring and bars, which are pointing toward the inner wall and are arranged at different positions in a circumferential direction of the rotor and at different positions along an axial direction of the rotor;

a feed opening for the powdered material being arranged above the blade ring; and an annular gap connectable to a liquid supply arrangement being arranged below the blade ring, wherein adjacent bars in the axial direction of the rotor one of connect to one another or overlap one another in the axial direction, so that, in rotation, axial extents of the adjacent bars overlap each other in the axial direction.

2. The apparatus according to claim 1, wherein bars adjacent in the axial direction of the rotor are separated by angular distances in the circumferential direction, and wherein the angular distances include a first angular distance that differs from an adjacent, second angular distance.

3. The apparatus according to claim 2, wherein the first angular distance is positive and the second angular distance is negative.

4. The apparatus according to claim 1, wherein the bars are arranged solely on a side of the blade ring facing away from the feed opening.

5. The apparatus according to claim 4, wherein, with respect to the axial direction of the rotor, the bars are arranged on both above and below the annular gap.

6. The apparatus according to claim 1, wherein small distances are embodied between radial outer ends of the bars and the inner wall.

7. The apparatus according to claim 1, wherein the blade ring comprises radially extending blades oriented, at least at their radial outsides, at an angle to the circumferential direction in a range of 2° to 8°.

8. The apparatus according to claim 7, wherein the blades comprise a twist about a blade axis extending from a radial inside to a radial outside.

9. The apparatus according to claim 1, wherein at least one of the housing and the rotor comprise a heating device.

10. A apparatus for mixing a powdered material with a liquid, comprising:

a housing in which a working space having an inner wall is arranged;

a rotatably-driven rotor being arranged in the working space, the rotatably-driven rotor comprising a blade ring and bars, which are pointing toward the inner wall and are arranged at different positions in a circumferential direction of the rotor;

a feed opening for the powdered material being arranged above the blade ring; and an annular gap connectable to a liquid supply arrangement being arranged below the blade ring, wherein, in a direction parallel to an axial direction of the rotor, the bars one of connect to one another or overlap one another, wherein the housing further comprises:

an outlet at a bottom end of the working space, wherein a bottom edge of a bar adjacent to the outlet is flush with the bottom edge of the working space, and an outlet section connected to the outlet.

11. The apparatus according to claim 10, wherein the outlet section comprises a radial recess in an outward direction across from the outlet.

12. The apparatus according to claim 11, wherein the radial recess corresponds at least to a thickness of a wall of the housing surrounding the working space.

13. The apparatus according to claim 10, wherein the outlet section is formed from an elastic material.

14. The apparatus according to claim 10, wherein the outlet section widens away from the outlet.

15. The apparatus according to claim 10, wherein the outlet section comprises a non-stick surface.

16. A method for mixing a powdered material with a liquid, comprising:

supplying the powdered material into a working space having an inner wall;

distributing the powdered material onto the inner wall via a blade ring arranged within the working space;

wetting the powdered material below the blade ring with the liquid; and intermixing the powdered material with the liquid via bars radially extending toward the inner wall from a rotor arranged within the working space, wherein the radially extending bars are axially positioned along the rotor and circumferentially positioned around the rotor so that, adjacent bars in the axial direction of the rotor one of connect to one another or overlap one another in the axial direction, and so that, in rotation, axial extents of the adjacent bars overlap each other in the axial direction, whereby for the axial extent of the radially extending bars, there is virtually no region in the axial direction in which the powdered material is not impinged by the bars.

17. The method according to claim 16, further comprising:

scraping the intermixed powered material and liquid off the inner wall with a bottommost bar arranged adjacent an outlet formed in a bottom of the working space.

18. The method according to claim 17, further comprising:

guiding the scraped intermixed powered material and liquid to the outlet.

19. The method according to claim 16, wherein the wetting comprises distributing the liquid to the powdered material via impingement with the bars.

20. The method according to claim 16, wherein the bars do not contact the inner wall.

* * * * *